United States Patent [19]

Marolda, Jr.

[11] Patent Number: 4,909,751

[45] Date of Patent: Mar. 20, 1990

[54] UNDERWATER MATEABLE ELECTRICAL CONNECTOR

[75] Inventor: Victor J. Marolda, Jr., Salem, Conn.

[73] Assignee: The United States of America as represented by the Secretary of the Navy, Washington, D.C.

[21] Appl. No.: 246,702

[22] Filed: Sep. 20, 1988

[51] Int. Cl.[4] ..... H01R 13/52

[52] U.S. Cl. ..... 439/273; 439/936

[58] Field of Search ..... 439/271–283, 439/199, 200, 201, 205, 206, 936

[56] References Cited

U.S. PATENT DOCUMENTS

| | | | |
|---|---|---|---|
| 2,700,140 | 1/1955 | Phillips | 439/274 |
| 4,085,993 | 4/1978 | Cairns | 439/276 |
| 4,479,690 | 10/1984 | Inouye et al. | 439/275 |
| 4,588,247 | 5/1986 | Grappe et al. | 439/276 |
| 4,780,091 | 10/1988 | Shenton | 439/272 |

*Primary Examiner*—David Pirlot

*Attorney, Agent, or Firm*—Michael J. McGowan; Prithvi C. Lall

[57] ABSTRACT

A plug-receptacle type electrical connector in combination with a thin, circular, elastomeric membrane joining a plurality of cylindrical elastomeric embossments formed as an integral part thereof. Each embossment further has conical ends at each extremity and an outside diameter slightly larger than the receptacle socket cavity it will contact. Each embossment also has a longitudinal through-hole of inside diameter (ID) slightly smaller than the electrical connector plug pin it is intended to fit over. The membrane is coated with a dielectric grease and slipped over the plug pins. Connector clamping forces produce hydrostatic forces, first on each embossment which causes water remaining between the pin and the embossment ID and then pin-to-pin to be broken into a discontinuous series of microspheres. The resulting discontinuity produces full electrical isolation for the assembled pins and sockets and pin-to-pin for the mated connector. Total refurbishment of a connector may thus be accomplished in situ.

1 Claim, 1 Drawing Sheet

UNDERWATER MATEABLE ELECTRICAL CONNECTOR

STATEMENT OF GOVERNMENT INTEREST

The invention described herein may be manufactured and used by or for the Government of the United States of America for governmental purposes without the payment of any royalties thereon or therefor.

This patent application is co-pending with a related patent application entitled "An Elastomeric, Electrical Isolation Membrane" by the same inventor filed on the same date as this patent application.

BACKGROUND OF THE INVENTION (1) Field of the Invention

The present invention relates to elastomeric means for providing electrical connector pin isolation and more particularly to a means for achieving full electrical connection between corresponding pins and sockets of an electrical connector as well as full pin-to-pin electrical isolation while the connector is immersed in a wet environment without requiring removal of the connector from such environment.

(2) Description of the Prior Art

It is well known that many types of electrical connectors are attached to equipments which are deployed underwater such as sonar systems and the like. Such equipment requires repair or routine maintenance from time to time. This repair or maintenance however necessitates removal of the equipment from the submerged location and therefor concomitant disconnection of all electrical connectors attached thereto. On occasion connector seals have failed, the connectors themselves have flooded and then shorted pin-to-pin, requiring replacement or refurbishment. In order to then reconnect the removed equipment or repair the connectors, the installation location must somehow be made dry or else one of the present, commercially available, underwater (UW) mateable type electrical connectors must have been used to begin with. These present underwater mateable connectors however are well known to be bulky, expensive and generally not available in sufficient quantity. Further, when intended for submarine sonar use, present UW mateable connectors are also of limited value due to their not having been designed to meet exacting military specifications. What is needed is a means for permitting existing, relatively inexpensive, dry-assembly type, electrical connectors to be made capable of direct underwater disassembly, in-place refurbishment and reconnection yet still provide full electrical function, thus eliminating the need to resort to dry-docking or the like.

SUMMARY OF THE INVENTION

Accordingly, it is a general purpose and object of the present invention to provide a means for permitting electrical connectors to be mated underwater such that full electrical isolation is established.

It is a further object that such electrical isolation means be useable in combination with existing, dry-assembly type, underwater electrical connectors.

Another object is that such electrical isolation means be producible at low cost.

Still another object is that such electrical isolation means exhibit dielectric properties while having a high degree of hydrolytic stability.

These objects are accomplished with the present invention by providing a plug-receptacle type electrical connector combined with a thin, generally circular, elastomeric membrane which joins together a plurality of cylindrical elastomeric embossments formed as an integral part thereof. The membrane is coated with a dielectric grease and slipped over the connector plug pins. During assembly connector clamping forces produce hydrostatic forces on the membrane which forces, in turn, cause any water remaining between connector pins to be broken into a discontinuous series of microspheres. This resulting discontinuity produces full pin-to-pin electrical isolation for the assembled plug pins and receptacle sockets of the mated connector.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
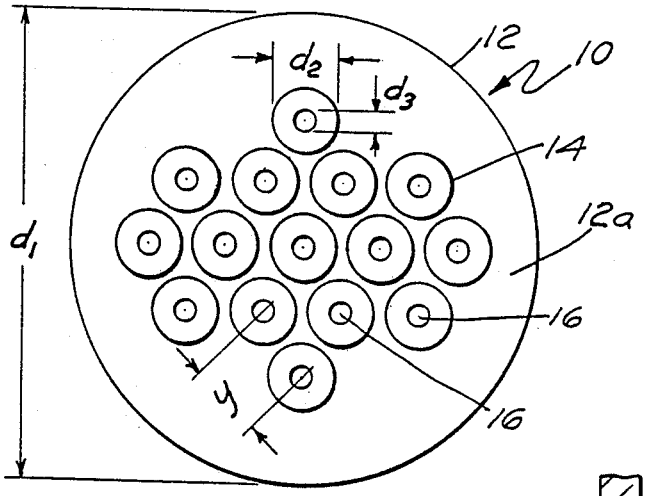
FIG. 1 shows a top view of a typical electrical isolator device according to the present invention.

Referring now to FIG. 1 there is shown an electrical isolation device 10 comprising a thin circular membranous elastomeric disk 12 of outside diameter "$d_1$". Disk 12 connects a plurality of protruding cylindrical elastomeric embossments 14 of preselected outside diameter "$d_2$" and inside diameter "$d_3$", diameter "$d_3$" forming apertures 16. The shape, quantity, spacing ("y") and pattern of embossments 14 are selected based on the pin configuration of the electrical connector that device 10 will be used in conjunction with. Membrane 12 maintains the selected alignment of embossments 14. Device 10 is formed by molding a dielectric elastomeric material selected to have good hydrolytic stability, i.e. resistance to hydrolysis effects, into the desired shape. The preferred embodiment uses a neoprene rubber of Shore durometer 45–50 but any other dielectric elastomer which is hydrolytically stable may be substituted without deviating from the teachings of the present invention.

Figure 2:
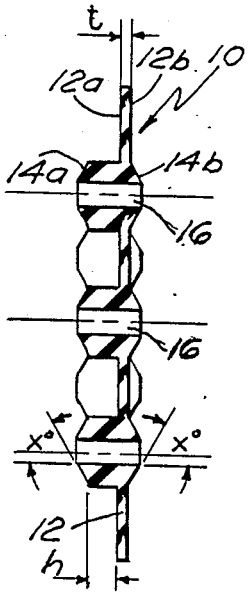
FIG. 2 shows a cross sectional view of the device of FIG. 1 taken along line 2—2 thereof.

FIG. 2 shows a cross sectional view of the electrical isolation device 10 of FIG. 1. Disk 12 is of thickness "t" which in the preferred embodiment is 0.030–0.035 inches thick. Disk 12 further comprises a first side **12*a* and a second side 12*b*. Each cylindrical embossment 14 further has a first protruding end 14*a* on side 12*a*, a second protruding end 14*b* on side 12*b* and a longitudinal center line parallel to all other embossment 14 center lines. Each protruding end 14*a* and 14*b* has formed thereon a conical taper of angle "x", which angle is preselected to contact the pin socket recesses of the connector it will be used in conjunction with. In the preferred embodiment, angle "x" is selected to be 60 degrees. In addition, first protruding end 14*a*** has a cylindrical extension of height "h" where "h" may be selected to be zero or greater.

Figure 3:
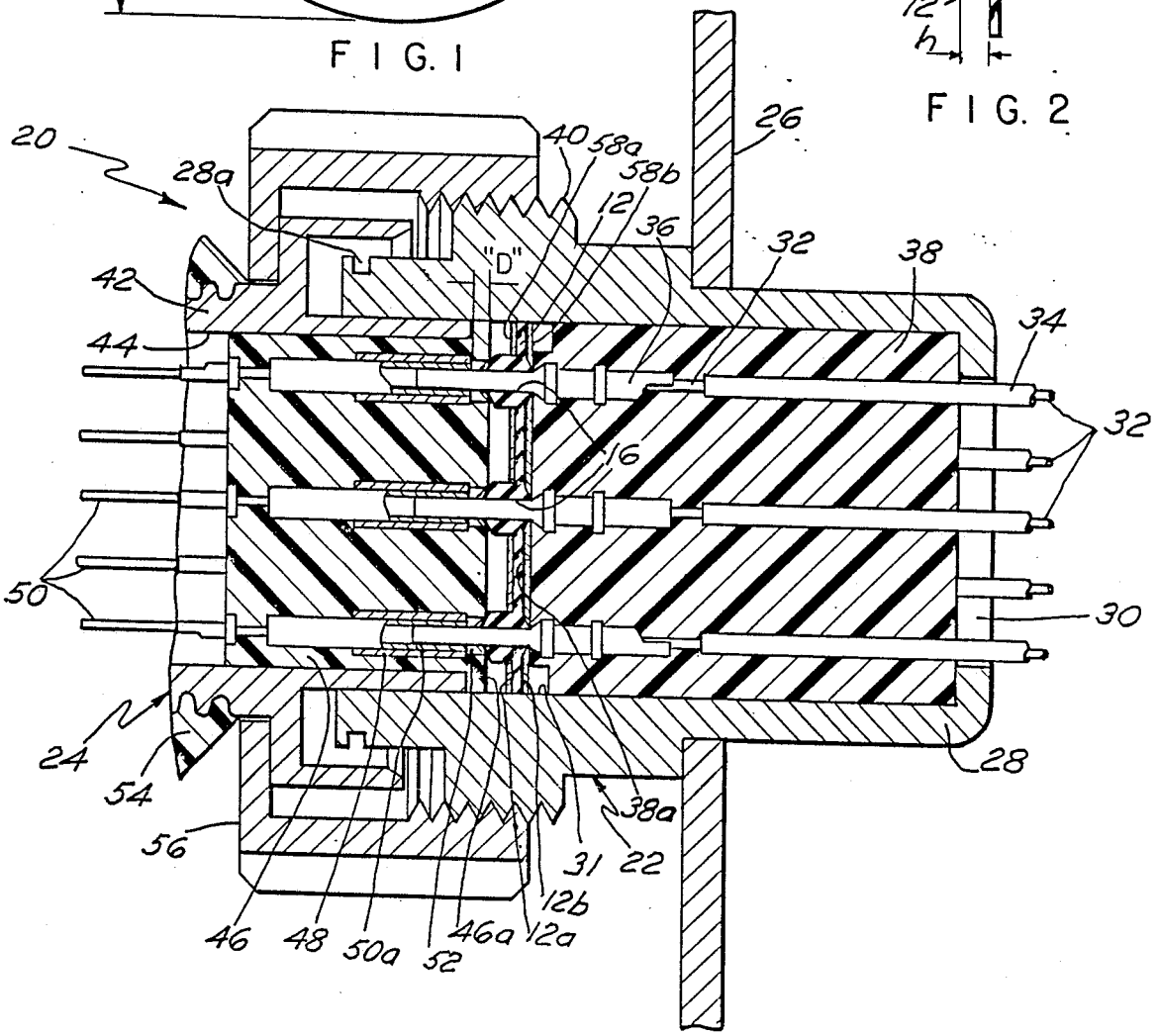
FIG. 3 shows an installation of the device of FIG. 1 in combination with a typical, dry assembly, electrical connector thereby forming an electrical joint having full pin-to-pin electrical isolation.

FIG. 3 shows electrical isolation device 10 used in combination with a typical, open face pressure tolerant, dry-assembly type electrical connector 20 such as a MIL-C-2431 which, along with removal of an "O" ring, is thereby converted into an underwater mateable connector without requiring further modification. This provides electrical isolation between pins which do not physically touch each other. Connector 20 further comprises a male plug section 22 and a female receptacle section 24. Plug section 22 is shown fixedly mounted through a wall or hull 26 but may also be used as part of a free standing coupling system. Plug section 22 further comprises a cylindrical metal body 28 having an optional "O" ring groove and a circular aperture 30 at one end sized slightly smaller than deep bore 31 which passes almost therethrough. A plurality of electrical wires 32 from a cable, wire harness or the like pass through aperture 30 at the cable end of body 28 and into the internal bore 31 cavity, each wire being covered with insulation 34. Within body 28 each wire 32 conductively attaches to a corresponding pin of a plurality of solid metal, plug pins 36 which are arranged in a preselected pattern parallel to each other but not in physical contact. Wires 32 and plug pins 36 are, except for a portion of each pin opposite the wire end, embedded in a cylindrical elastomer block 38 which fills the remaining volume inside the body 28 cavity formed by bore 31 and provides open face **38*a* pressure tolerance for plug end 22. This leaves a portion of each pin extending beyond face 38*a* at the end of body 28 opposite the cable attachment end, hereafter called the pin end. The exterior of metal body 28 has disposed thereabout a threaded section 40** on the extending pin end.

Receptacle section 24 of connector 20 further comprises a generally cylindrical metal body 42 having an aperture 44 of a preselected ID formed therethrough. Aperture 44 has a cylindrical elastomeric receptacle block 46 in contact therewith, block 46 further comprising a face **46*a* and a plurality of metal sleeves 48 embedded therein at the face 46*a* end thereof, extending to within a preselected distance "D" of face 46*a*. Sleeves 48 are disposed in a pattern corresponding to plug pin 36 pattern of plug end 22. A plurality of metal receptacle pins 50, one each corresponding to one plug pin 36, are disposed in parallel through block 46, each of pins 50 having hollow ends 50*a* which extend through sleeves 48 flush with the sleeve 48 end nearest to surface 46*a* of block 46 which is in turn nearest to plug end 22. Block 46 is formed around receptacle pins 50 providing open face pressure tolerance for face 46*a*. A corresponding plurality of cylindrical apertures 52 in block 46 align with each hollow end 50*a* and sleeve 48, each aperture 52 being slightly larger in diameter than the outside diameter of the corresponding hollow end 50*a* and extending a preselected depth "D" in from surface 46*a* of block 46. Each receptacle pin end opposite hollow end 50*a*, is conductively connected to an attached cable means and potted with an elastomeric material 54. A threaded clamping ring 56 is provided over body 42 having a thread disposed within which mates with thread 40 of body 28**.

When used in conjunction with conventional electrical connectors the original "O" rings are removed from grooves **28*a* in body 28 of 20. This allows free flooding of the plug and receptacle cavities between faces 38*a* and 46*a*. Such grooves and seals of course are not necessary for new design connector configurations. In operation, the absence of an occlusive seal prevents hydrostatic pressures from being built up early in the receptacle-plug engagement phase. It also reduces the possibility of cable hosing (i.e., flooding), corrosion and low resistance failure due to pressure built up while clamping. Before assembly, sides 12*a* and 12*b*, and apertures 16 of device 10 are lubricated all over with commercially available underwater dielectric grease, shown generally as 58*a* and 58*b* respectively, such as a Dow Corning Corp. MIL-S-8660-C Silicon Compound or the like. Apertures 16 of electrical isolation device 10 are then slipped over the plurality of male plug pins 36 with grease 58*b* coming into contact with face 38*a*. Female receptacle section 24 is engaged plug pin 36 to receptacle pin 50 and tightening is started. As the conical ends of embossments 14*a* come in contact with the bottom of the respective apertures 52, a cleansing and purging of dielectric grease and water begins at face 46*a*. The grease-water mixture is pushed from the male pin 36 up along the conical surface 14*a* and out of the female cavity 52. When the cavity is completely filled by embossment 14*a* and tightening is continued, grease covered sides 12*a* and 12*b* come in contact with faces 46*a* and 38*a* respectively at which point hydrostatic pressure causes most grease and water to be squeezed out and once tightening is complete any remaining water is broken up into a discontinuous series of microspheres. Grease 58*a* first comes in contact with face 46*a* and then as further tightening occurs sides 12*a* and 12*b* of membrane 12 also came into contact with faces 46*a* and 38*a*** respectively, thereby completeing electrical isolation for the connector.

The advantages of the present invention over the prior art are that standard inexpensive electrical connectors can be easily adapted to underwater use and be reconnected in place without removal or dry-docking needed for the systems to which they attach.

What has thus been described is an underwater mateable plug-receptacle type electrical connector which includes a thin, circular, elastomeric membrane joining a plurality of cylindrical elastomeric embossments formed thereon. Each embossment further has a pair of conical ends and an outside diameter slightly larger than the receptacle socket cavity it will come in contact with. Each embossment also has a longitudinal throughhole of inside diameter (ID) slightly smaller than the electrical plug pin it is intended to fit over. Connector clamping forces produce hydrostatic forces on each embossment which causes water remaining between the pin and the embossment ID and pin-to-pin to be broken into a discontinuous series of microspheres. The resulting discontinuity produces full electrical isolation for the assembled pins and sockets and pin-to-pin for the mated connector.

Obviously many modifications and variations of the present invention may become apparent in light of the above teachings. For example: Isolation device 10 can be used with electrical connectors in any wet, rainy or even humid environment or where splash proofing is desired in lieu of use only in underwater connector applications. Angle "x" of each embossment cone can be varied to suit the shape and size of the counterbore recess aperture 52 configuration of the connector receptacle section. The connector type can be chosen from any of a large number of existing commercial or military connectors or may be designed for a desired application.

In light of the above, it is therefore understood that within the scope of the appended claims, the invention may be practiced otherwise than as specifically described.

What is claimed is:

1. An electrical connector, comprising:

an open face pressure tolerant plug end, having a plurality of metal pins disposed thereover in a preselected pattern, said pins protruding beyond the face of said plug end;

an open face pressure tolerant receptacle end, adapted to be connected to said plug end, said receptacle end having a plurality of embedded metal sleeves positioned so as to create a recess of depth "D" from said socket end face and disposed in a pattern corresponding to said pin pattern, each said sleeve further having an inner diameter which accommodates insertion of said corresponding pin;

an elastomeric electrical isolation membrane means, said membrane means having a circular dielectric elastomer disk and a plurality of dielectric cylindrical elastomer embossments fixedly attached to said elastomer disk at preselected locations so as to form a preselected pattern that matches said preselected pin and socket patterns and being disposed between said plug end and said receptacle end and over each said pin, for providing dielectric insulation between adjacent pins; and a dielectric grease, applied over all surfaces of said isolation membrane means, for providing, in combination with said isolation membrane means, the breaking up of any residual water within said connector into a discontinuous series of microspheres upon tightening of said connector while submerged in an aqueous environment, such tightening producing hydrostatic forces on said grease and said isolation means;

whereby an underwater mateable electrical connector is formed.

* * * * *